US007305838B2

(12) United States Patent
Fornof

(10) Patent No.: US 7,305,838 B2
(45) Date of Patent: Dec. 11, 2007

(54) COOLING COMPRESSOR INTAKE AIR

(75) Inventor: William P. Fornof, Girard, OH (US)

(73) Assignee: Bendix Commercial Vehicle Systems LLC, Elyria, OH (US)

( * ) Notice: Subject to any disclaimer, the term of this patent is extended or adjusted under 35 U.S.C. 154(b) by 183 days.

(21) Appl. No.: 11/098,950

(22) Filed: Apr. 5, 2005

(65) Prior Publication Data

US 2006/0218938 A1 Oct. 5, 2006

(51) Int. Cl.
*F25D 17/06* (2006.01)

(52) U.S. Cl. ..... 62/93; 62/291; 62/401

(58) Field of Classification Search ..... 62/90, 62/92, 93, 96–98, 179, 285, 286, 291, 401, 62/402, 3.2
See application file for complete search history.

(56) References Cited

U.S. PATENT DOCUMENTS

| | | | | |
|---|---|---|---|---|
| 2,632,315 | A * | 3/1953 | Coblentz | 62/271 |
| 3,034,315 | A * | 5/1962 | Coblentz | 62/272 |
| 3,877,218 | A * | 4/1975 | Nebgen | 60/775 |
| 4,137,058 | A * | 1/1979 | Schlom et al. | 62/121 |
| 4,237,696 | A | 12/1980 | Coblentz | |
| 4,680,938 | A | 7/1987 | Caley | |
| 4,707,166 | A | 11/1987 | Khosropour | |
| 5,444,971 | A * | 8/1995 | Holenberger | 60/783 |
| 5,632,148 | A * | 5/1997 | Bronicki et al. | 60/728 |
| 5,699,673 | A * | 12/1997 | Hoshino et al. | 62/93 |
| 6,375,722 | B1 | 4/2002 | Henderson et al. | |
| 6,412,291 | B1 | 7/2002 | Erickson | |
| 6,457,315 | B1 * | 10/2002 | Lee et al. | 60/772 |
| 6,494,057 | B1 | 12/2002 | Schuster et al. | |
| 6,691,428 | B1 | 2/2004 | Zarif | |
| 6,739,119 | B2 * | 5/2004 | Erickson | 60/39.53 |
| 6,804,323 | B2 | 10/2004 | Moriya et al. | |
| 6,938,405 | B2 * | 9/2005 | Carberg et al. | 60/39.53 |

FOREIGN PATENT DOCUMENTS

| | | | |
|---|---|---|---|
| JP | 08 200226 | A | 8/1996 |
| JP | 10-267526 | A * | 10/1998 |
| JP | 2000 257563 | A | 9/2000 |

OTHER PUBLICATIONS

PCT Written Opinion of the International Searching Authority on International Application PCT/US2006/004091, Jul. 27, 2006.
PCT International Search Report on International Application PCT/US2006/004091, Jul. 27, 2006.

* cited by examiner

*Primary Examiner*—Mohammad M. Ali
(74) *Attorney, Agent, or Firm*—Calfee, Halter & Griswold LLP

(57) ABSTRACT

Cooling air provided to a compressor air inlet such that water vapor in the inlet air condenses to lower a moisture content of the air provided to the compressor.

4 Claims, 4 Drawing Sheets

COOLING COMPRESSOR INTAKE AIR

FIELD OF THE INVENTION

The present disclosure relates generally to air compressors used in vehicles, and more particularly, to cooling air provided to an air inlet of a vehicle air compressor.

BACKGROUND OF THE INVENTION

Modern trucks include air compressors which are used to charge an air tank from which air-powered systems, such as service brakes, windshield wipers, air suspension, etc., can draw air. Water vapor in the ambient air is concentrated at the outlet of the compressor and generally condenses as the compressed air cools. An air dryer is typically disposed between the compressor and the air tank. The air dryer removes liquid and water vapor from compressor discharge air before the air is provided to the air tank. Typical air dryers include a desiccant type filtration system. The air dryer provides clean, dry air to the reservoir.

SUMMARY

An embodiment of the present invention relates to cooling air provided to a compressor air inlet such that water vapor in the inlet air condenses before reaching the compressor to lower the moisture content of the air provided to the compressor. One arrangement for cooling air provided to a vehicle air compressor includes a conduit and a cooling device. The conduit routes air to a compressor air inlet. The cooling device cools air routed to the compressor air inlet and reduces the moisture content of the air that is provided to the compressor air inlet.

One controller for controlling a cooling device to control the temperature and moisture content of air provided to an air inlet of a vehicle air compressor includes an input, a logic applying arrangement, and an output. The input is configured to receive input signals that represent a loaded or unloaded status of the vehicle air compressor, a temperature of air provided to the compressor air inlet, and/or a moisture content of air provided to the compressor air inlet. The logic applying arrangement applies a temperature control algorithm to the input signals to derive output signals. The output provides the output signals to the cooling device to control the cooling device based on the input signals.

Further advantages and benefits will become apparent to those skilled in the art after considering the following description and appended claims in conjunction with the accompanying drawings.

DETAILED DESCRIPTION

Figure 1:
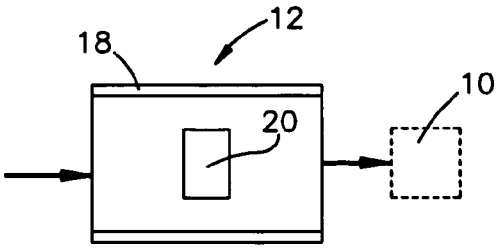
FIG. 1 is a schematic illustration of an air cooling arrangement for cooling air provided to a compressor inlet.

The present invention relates to cooling air provided to a compressor air inlet 10 such that water vapor in the air condenses before reaching the compressor to lower a moisture content of the air provided to the compressor air inlet 10. FIG. 1 illustrates an example of an air cooling arrangement 12 for cooling air provided to a vehicle air compressor air inlet 10. In the example illustrated by FIG. 1, the air cooling arrangement 12 includes a conduit 18 and a cooling device 20. The conduit 18 routes air to the compressor air inlet 10. The cooling device 20 cools air routed to the compressor air inlet and reduces the moisture content of the air that is provided to the air compressor air inlet 10.

In the exemplary embodiment, the cooling device 20 cools the air to a temperature that is below the dew point of the air. When the air temperature is reduced below the dew point, water vapor condenses on the cooling device 20. As a result, the moisture content in the air provided to the compressor inlet is reduced. In one embodiment, the cooling device 20 cools the air to a temperature that is below the freezing point of water. For example, the cooling device 20 may cool the air provided to the compressor to temperatures in the range from 0 to −40 degrees Fahrenheit. Water vapor in the air will condense as frost on the cooling device 20 to reduce the moisture content of the air provided to the compressor air inlet 10.

Figure 2:
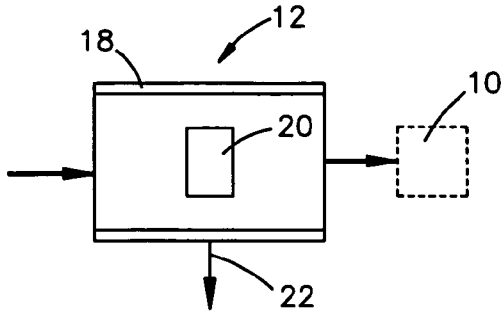
FIG. 2 is a schematic illustration of an air cooling arrangement for cooling air provided to a compressor inlet.

FIG. 2 illustrates an embodiment where the cooling arrangement 12 includes a drain 22 for removing condensed moisture from the conduit 18. A drain 22 may be included in any of the illustrated embodiments. In an exemplary embodiment, the cooling arrangement 12 is controlled to cool the air provided to the compressor inlet 10 when the compressor is in a loaded state and inhibited from cooling the air when the compressor is in an unloaded state. Typically, the compressor compresses air when in the loaded state, but does not compress air when in the unloaded state. In one embodiment, frost on the cooling device 20 melts and flows out the drain 22 when the compressor is in the unloaded state and the cooling device is inhibited from cooling the air.

Figure 3:
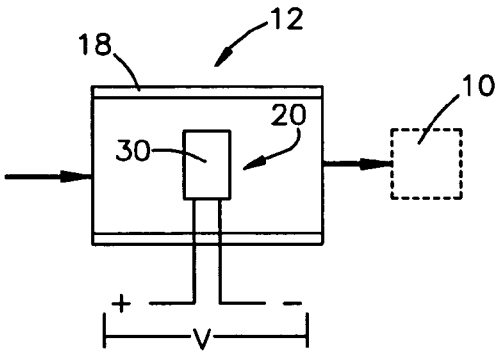
FIG. 3 is a schematic illustration of an air cooling arrangement for cooling air provided to a compressor inlet.

FIG. 3 illustrates an example where the cooling device 20 comprises an electric cooling device 30. When a voltage V is applied across the cooling device 20, the heat is drawn away from a surface of the of the cooling device and the temperature of the surface decreases. One acceptable electric cooling device is a Peltier effect device. Peltier effect devices are also referred to as thermoelectric modules. Peltier devices are solid-state devices that function as heat pumps. An exemplary Peltier device is a few millimeters thick by a few millimeters to a few centimeters square. One Peltier device is a sandwich formed by two ceramic plates with an array of small Bismuth Telluride cubes in between. When a DC current is applied, heat is moved from one side of the device to the other. Heat is removed from the hot side of the device with a heat sink 31 (see FIG. 9). The cold side of the Peltier device is used to cool the air that flows through the conduit 18. If the current is reversed, the Peltier device reverses its heating and cooling sides. The hot side of the device becomes the cold side and the cold side of the device becomes the hot side. One acceptable Peltier device is part number TE-127-2.0-1.15, available from TE Technology, Inc.

Figure 4:
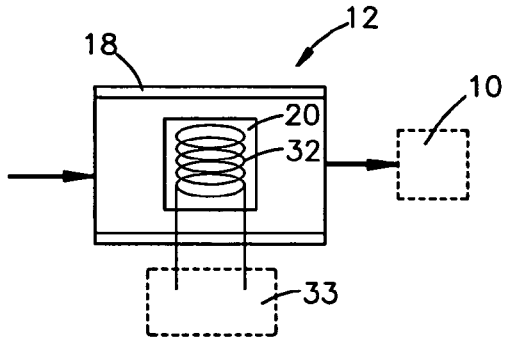
FIG. 4 is a schematic illustration of an air cooling arrangement for cooling air provided to a compressor inlet.
Figure 5:
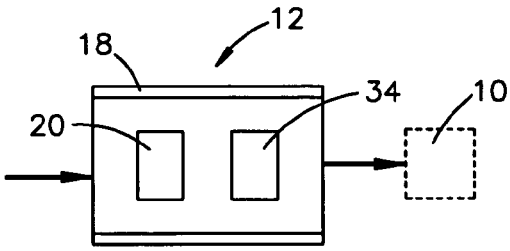
FIG. 5 is a schematic illustration of an air cooling arrangement for cooling air provided to a compressor inlet.

FIG. 4 illustrates an embodiment where the cooling device 20 comprises a heat exchanger 32 coupled to a vehicle air conditioning system 33. Cooled Freon or other cooling fluid is provided to the heat exchanger 32 to cool air that flows through the conduit 18.

FIGS. 5-9 illustrate embodiments where the cooling arrangement 12 includes a heating element 34 or a cooling element 20 that can operate in a heating mode and a cooling mode. In the exemplary embodiment, the heating element is controlled to heat the air provided to the compressor air inlet when the compressor is in an unloaded state. By heating when the compressor 14 (FIG. 10) is in the unloaded state, frost that forms on the cooling element 20 is melted. In the example illustrated by FIG. 5, the cooling arrangement includes a cooling element 20 and a heating element 34.

Figure 6:
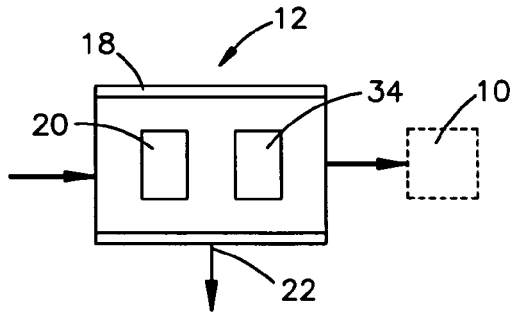
FIG. 6 is a schematic illustration of an air cooling arrangement for cooling air provided to a compressor inlet.

In the example illustrated by FIG. 6, the cooling arrangement 12 includes a drain 22 for removing condensed moisture and melted frost from the conduit 18. In an exemplary embodiment, the cooling device 20 is controlled to cool the air provided to the compressor inlet 10 when the compressor is in a loaded state and the heating element 34 is controlled to heat the air when the compressor is in an unloaded state.

Figure 7:
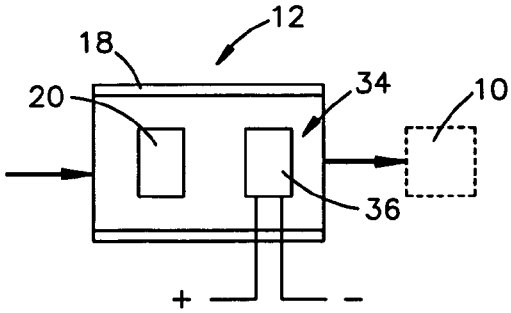
FIG. 7 is a schematic illustration of an air cooling arrangement for cooling air provided to a compressor inlet.

In the example illustrated by FIG. 7, the heating element 34 comprises an electric heating element 36. When a voltage V is applied to the heating element 36, the heating element 36 applies heat to the air in the conduit 18. One exemplary electric heating element 36 is a resistive heating element.

Figure 8:
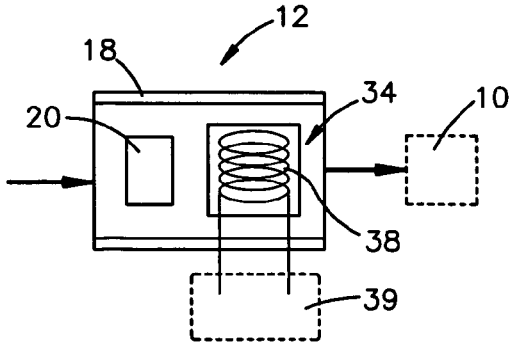
FIG. 8 is a schematic illustration of an air cooling arrangement for cooling air provided to a compressor inlet.

FIG. 8 illustrates an embodiment where the heating element 34 comprises a heat exchanger 38 coupled to a vehicle coolant system 39. In an exemplary embodiment, the cooling device 20 is controlled to cool the air provided to the compressor inlet 10 when the compressor is in a loaded state and the heating exchanger 38 is controlled to heat the air when the compressor is in an unloaded state. Engine coolant is provided to the heat exchanger 38 to heat air that flows through the conduit 18. The engine coolant is heated as the coolant removes heat from the vehicle engine.

Figure 9:
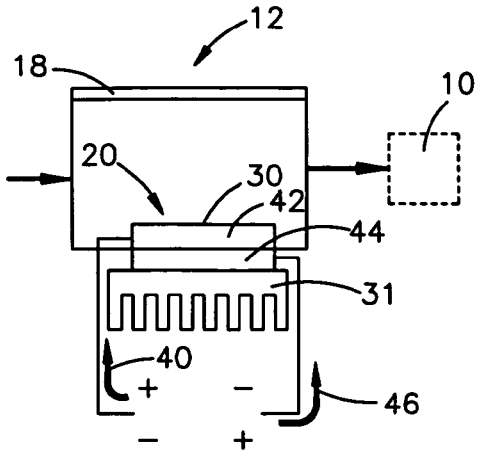
FIG. 9 is a schematic illustration of an air cooling arrangement for cooling air provided to a compressor inlet.

FIG. 9 illustrates an embodiment where the cooling element 20 is an electric device 30 that can be operated as a cooling element and as a heating element by reversing the current applied to the cooling element. One such electric device is a Peltier device described above. When current is applied in a first direction indicated by arrow 40 a first side 42 of the device cools and a second side 44 of the device heats. That is, heat is drawn from the first side 42 to the second side 44. In the example illustrated by FIG. 9, a heat sink 31 is attached to the second side 44 of the device to facilitate heat transfer from the device to surrounding air. When current is applied in a second direction indicated by arrow 46 the first side 42 of the device heats and a second side 44 of the device cools. That is, heat is drawn from the second side 44 to the first side 42. In the exemplary embodiment, the Peltier device is controlled to cool when the compressor is in a loaded state and to heat when the compressor is in an unloaded state.

Figure 10:
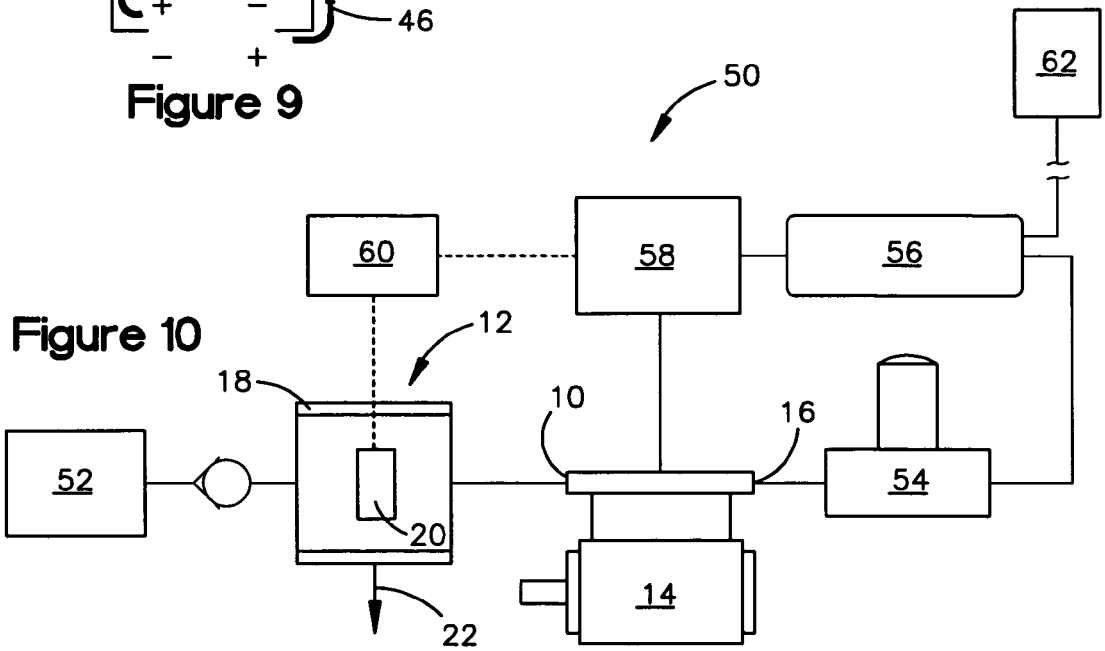
FIG. 10 is a schematic illustration of a vehicle air supply system that includes an air cooling arrangement for cooling air provided to a compressor inlet.

FIG. 10 illustrates an example of a vehicle air supply system 50 that includes a compressor intake air cooling arrangement 12. The system illustrated by FIG. 10 includes a vehicle air intake 52, a cooling arrangement 12, a compressor 14, an air drier 54, a compressed air reservoir 56, a governor 58, and a cooling arrangement controller 60. Air is received through the air intake 52 and passes through the cooling arrangement 12 to the compressor air inlet 10. The air is compressed by the compressor 14 and provided through a compressed air outlet 16 to the air drier 54. The air drier 54 removes additional moisture from the air and provides the compressed air to the reservoir 56. The compressed air reservoir 56 provides compressed air to one or more air powered systems 62 of the vehicle, such as a brake system. In the example of FIG. 10, the governor 58 senses the pressure of the compressed air in the air reservoir 56. The governor 58 controls the compressor 14 based on the pressure in the reservoir 56. In the exemplary embodiment, the governor places the compressor in a loaded state where the compressor compresses air when the pressure in the reservoir drops below a selected low air pressure limit. The governor places the compressor in an unloaded state where the compressor does not compress air when the pressure in the reservoir reaches a selected high air pressure limit. In the embodiment illustrated by FIG. 10, the controller 60 is coupled to the governor 58 to sense whether the compressor is in the loaded or the unloaded state. In one embodiment, the controller is coupled directly to the compressor 14 to determine whether the compressor is in the loaded or the unloaded state. In the example illustrated by FIG. 10, the controller 60 is in communication with the cooling element 20. The controller 60 causes the cooling device 20 to cool the air provided to the compressor inlet through the conduit when the compressor is operating in a loaded state and inhibits the cooling device from cooling the air provided to the compressor air inlet when the compressor is operating in an unloaded state. In the exemplary embodiment, cooling of the air causes moisture in the air to condense in the cooling arrangement to reduce the moisture content of the air provided to the compressor inlet 10. In the exemplary embodiment, the condensed moisture is removed from the conduit 18 through a drain 22 by gravity, by flowing air, or by other means.

Figure 11:
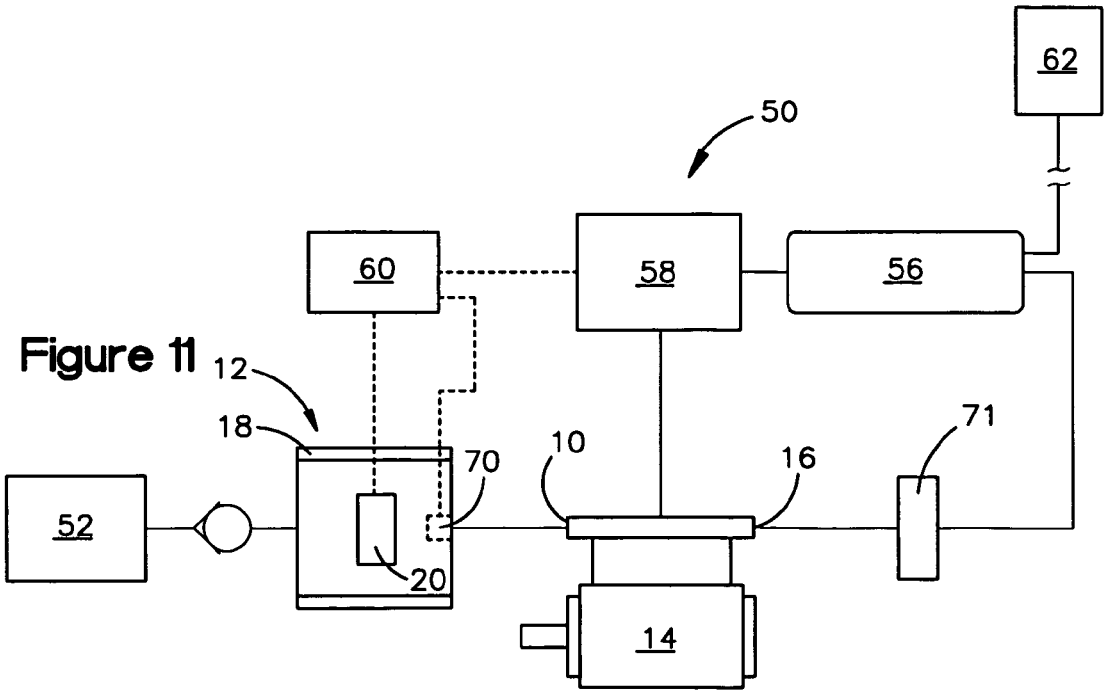
FIG. 11 is a schematic illustration of a vehicle air supply system that includes an air cooling arrangement for cooling air provided to a compressor inlet.

FIG. 11 illustrates an embodiment where the intake air cooling arrangement includes one or more sensors 70 disposed in the conduit 18. The sensor(s) measure parameters of the air provided to the compressor air inlet 10. For example, the sensor(s) 70 may be configured to sense the temperature and/or the moisture content of air provided to the compressor. The sensor(s) 70 provide signals that indicate the condition of the air provided to the compressor air inlet 10 to the controller 60. The controller 60 controls the cooling arrangement 12 based on the signals from the sensor 70. For example, the controller may activate the cooling device 20 when the sensed temperature of the compressor inlet air is above a high temperature set point. The controller may deactivate the cooling device 20 when the sensed temperature of the compressor inlet air is below a low temperature set point. The controller may activate the cooling device 20 when a sensed moisture content of the compressor inlet air is above a high moisture content set point. The controller may deactivate the cooling device 20 when the sensed moisture content of the compressor inlet air is below a low moisture content set point. In one embodiment, the controller 60 controls the cooling arrangement 60 based on the load status of the vehicle air compressor, the temperature of air provided to the compressor air inlet, and/or the moisture content of air provided to the compressor air inlet.

In the embodiment illustrated by FIG. 11, the vehicle air supply system 50 does not include a conventional air drier 54 (shown in FIG. 10). In an exemplary embodiment, the intake air cooling arrangement removes enough moisture from the air provided to the air compressor inlet 10 to eliminate the air drier 54. When the air that enters the compressor is dry, the possibility of condensation of water from air leaving the compressor during cooling is greatly reduced. In one embodiment, the air dryer 54 is replaced with a filter 71 that catches contaminants, such as oil, that may exit the compressor.

Figure 12:
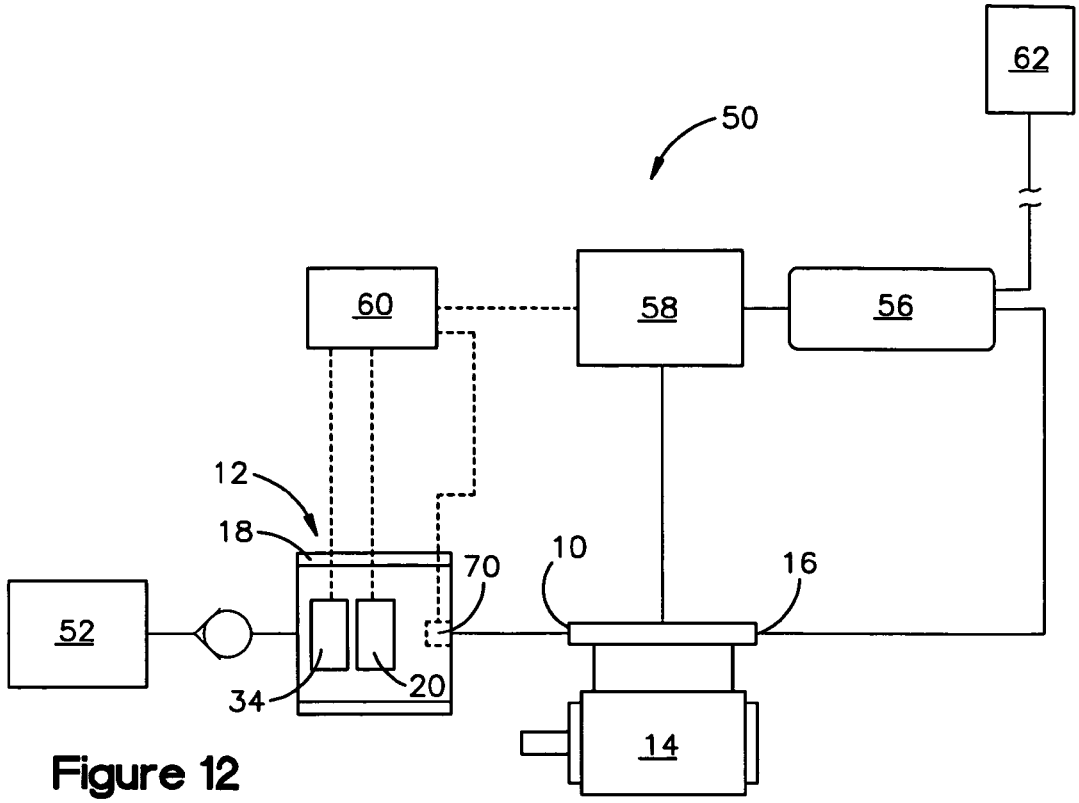
FIG. 12 is a schematic illustration of a vehicle air supply system that includes an air cooling arrangement for cooling air provided to a compressor inlet.

FIG. 12 illustrates an example where the air cooling arrangement 12 includes a heating element 34. The controller 60 controls the cooling device 20 and the heating element 34 to control the temperature and moisture content of the air provided to the compressor air inlet 10. In the embodiment illustrated by FIG. 12, the controller 60 receives compressor load state signals from the governor 58, temperature signals, and/or moisture content signals from the air cooling arrangement. The controller 60 controls the heating element 34 and the cooling device 20 based on the signals. For example, the controller may activate the cooling device 20 and deactivate the heating element 34 when the compressor is in a loaded state and deactivate the cooling device 20 and activate the heating element 34 when the compressor is in a unloaded state. The controller may deactivate the heating element 34 and activate the cooling device 20 when the sensed temperature of the compressor inlet air is above a high temperature set point. The controller may activate the heating element 34 and deactivate the cooling device 20 when the sensed temperature of the compressor inlet air is below a low temperature set point. The controller may deactivate the heating element 34 and activate the cooling device 20 when a sensed moisture content of the compressor inlet air is above a high moisture content set point. The controller may activate the heating element 34 and deactivate the cooling device 20 when the sensed moisture content of the compressor inlet air is below a low moisture content set point.

Figure 13:
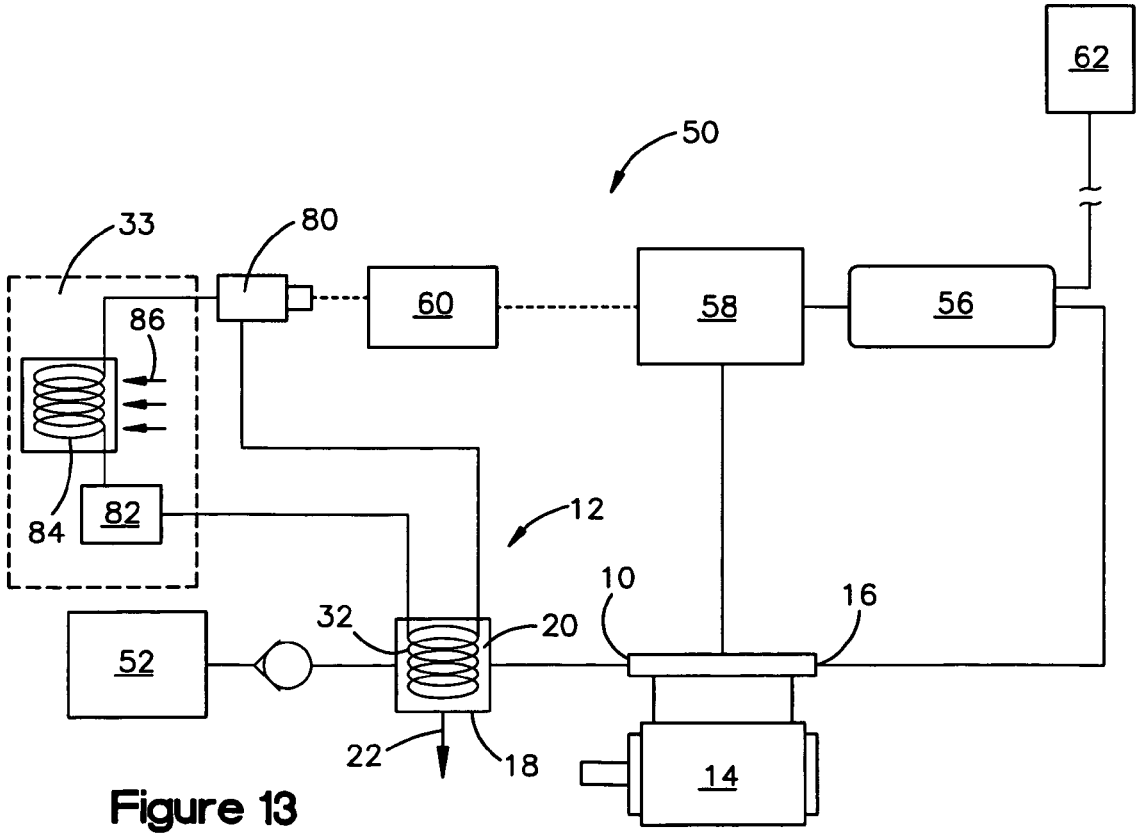
FIG. 13 is a schematic illustration of a vehicle air supply system that includes an air cooling arrangement for cooling air provided to a compressor inlet.

FIG. 13 illustrates a vehicle air supply system 50 with a cooling arrangement 12 that comprises a heat exchanger 32 coupled to a vehicle air conditioning system 33. The cooling arrangement 12 illustrated by FIG. 13 includes an expansion valve 80 and the heat exchanger 32. The illustrated vehicle air conditioning system 33 includes an air conditioning compressor 82, and an air conditioning heat exchanger 84. The air conditioning compressor 82 compresses air conditioning gas, such as Freon and supplies the air conditioning gas to the air conditioning heat exchanger 84. The compression of the air conditioning gas increases the temperature of the air conditioning gas. Air (indicated by arrows 86) is blown over the coil of the air conditioning heat exchanger to cool the air conditioning gas to a liquid. The air conditioning fluid expands as it passes through the expansion valve 80 to the heat exchanger 32. The expansion of the air conditioning fluid further reduces the temperature of the air conditioning fluid. The heat exchanger 32 cools the air provided to the compressor inlet 10. In the example illustrated by FIG. 13, the expansion valve 80 is controlled by the controller to regulate the cooling of the compressor intake air by the heat exchanger 32. For example, the controller 60 may close the expansion valve 80 to stop the flow of air conditioning fluid to the heat exchanger and thereby stop cooling of the air provided to the compressor inlet 10. The controller 60 may open the expansion valve 80 to allow flow of air conditioning fluid to the heat exchanger and thereby enable cooling of the air provided to the compressor inlet 10. In one embodiment, the heat exchanger 32 is an auxiliary heat exchanger that is controlled separately from a cooling heat exchanger of the air conditioning system that cools a cabin of the vehicle. In this embodiment, the compressor 82 and the heat exchanger 84 remove heat from air conditioning fluid that is provide cooled air conditioning fluid to the cabin cooling heat exchanger and the heat exchanger 32 that cools the compressor inlet air.

Figure 14:
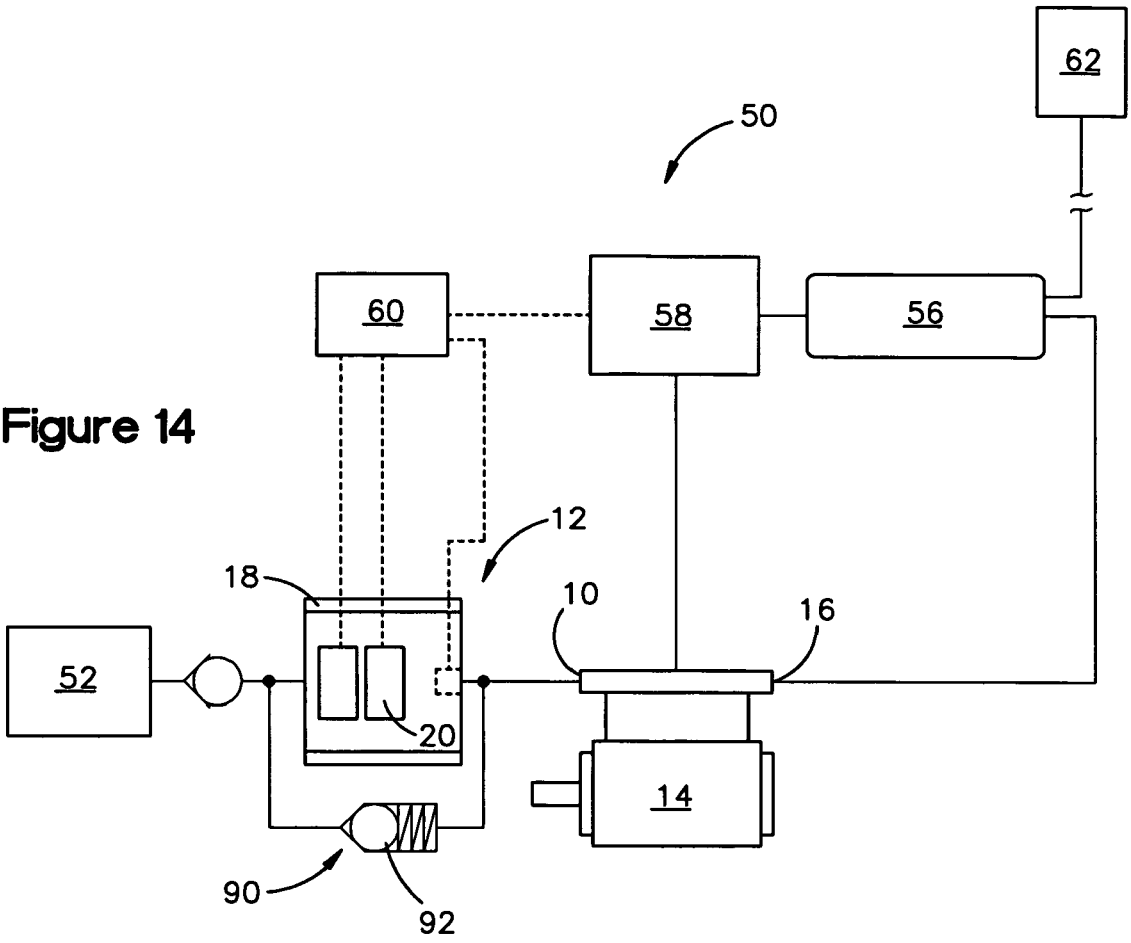
FIG. 14 is a schematic illustration of a vehicle air supply system that includes an air cooling arrangement for cooling air provided to a compressor inlet.

FIG. 14 illustrates an example of a vehicle air supply system 50 that includes a bypass 90. The bypass 90 allows air to flow from the air intake 52 to bypass the cooling arrangement 12 if the cooling arrangement becomes blocked. In the example illustrated by FIG. 14, the bypass 90 includes a check valve 92. A small amount of pressure is required for air to flow through the check valve. When the cooling arrangement 12 is not blocked, the air from the air intake 52 flows through the cooling arrangement conduit 18 to the compressor air inlet 10. A significant amount of air does not flow through the check valve 92, because the cooling arrangement conduit 18 is the path of least resistance. If the cooling arrangement becomes blocked, the air from the air intake opens the check valve 92 and flows to the compressor air inlet 10.

Figure 15:
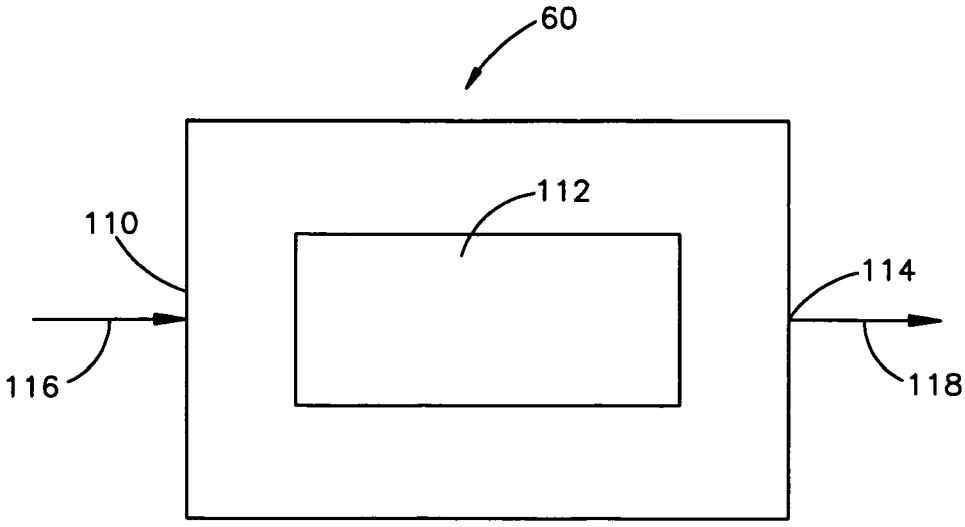
FIG. 15 is a schematic illustration of a controller for an arrangement for cooling air provided to an inlet of an air compressor.

FIG. 15 schematically illustrates an example of a controller 60 for controlling a cooling arrangement 12 to control a temperature and moisture content of air provided to an air inlet 10 of a vehicle air compressor 14. The illustrated controller 60 includes an input 110, a logic applying arrangement 112, and an output 114. The input 110 receives input signals 116 that represent the load status of the vehicle air compressor, the temperature of air provided to the compressor air inlet, and/or a moisture content of air provided to the compressor air inlet. The logic applying arrangement 112 applies a temperature control algorithm to the input signals 116 to derive output signals 118. The output 114 provides the output signals 118 to the cooling device 20 to control the cooling device based on the input signals.

In an exemplary embodiment, the cooling arrangement 12 produces dry air that is provided to an inlet 10 of the compressor 14. Providing dry air to the inlet of the compressor reduces the possibility of condensation of water from air that leaves the compressor. Cooling the air provided to the compressor inlet also produces denser air which may result in improved compressor efficiency.

While the invention has been described with reference to specific embodiments, it will be apparent to those skilled in the art that may alternatives, modifications, and variations may be made. Accordingly, the present invention is intended to embrace all such alternatives, modifications, and variations that may fall within the spirit and scope of the appended claims.

The invention claimed is:

1. An air cooling arrangement for cooling air provided to a vehicle air compressor having an air inlet and a compressed air outlet, the air cooling arrangement comprising:

a) a conduit for routing air to the compressor air inlet; and b) a cooling device that cools air routed to the compressor air inlet to a temperature below the freezing point of the moisture and reduces a moisture content of the air that is provided to the air compressor air inlet.

2. The air cooling arrangement of claim 1 further comprising a drain for removing condensed moisture from the conduit.

3. A method of conditioning air provided to an air inlet of a vehicle air compressor comprising: cooling air provided the air compressor air inlet such that moisture in the air condenses to reduce a moisture content of the air provided to the compressor air inlet by cooling the air provided to the air compressor air inlet to a temperature below the freezing point of the moisture.

4. An air cooling arrangement for cooling air provided to a vehicle air compressor having an air inlet and a compressed air outlet, the air cooling device comprising:

a) a means for routing air to the compressor air inlet;

b) a means for cooling air routed to the compressor air inlet and reducing a moisture content of the air that is provided to the air compressor air inlet;

c) a means for removing condensed moisture from the conduit; and d) a means for cooling the air provided to the air compressor air inlet to a temperature below the freezing point of the moisture.

* * * * *